United States Patent [19]

Lawson

[11] Patent Number: 4,461,106

[45] Date of Patent: Jul. 24, 1984

[54] INTERMESHED AND INTERLEAVED DYNAMIC DISPLAY UNITS

[76] Inventor: David A. Lawson, Woodreed Farmhouse, Stonehurst La., Five Ashes, nr. Mayfield, East Sussex, England

[21] Appl. No.: 376,081

[22] Filed: May 7, 1982

[30] Foreign Application Priority Data

May 19, 1981 [GB] United Kingdom ..... 8115277

[51] Int. Cl.[3] ..... G09F 11/02

[52] U.S. Cl. ..... 40/505; 40/430

[58] Field of Search ..... 40/473, 503, 505, 504, 40/507, 430, 10 D, 539, 358, 414, 423, 456; 46/1 L, 140, 75; 366/69, 70

[56] References Cited

U.S. PATENT DOCUMENTS

| | | | |
|---|---|---|---|
| 1,112,921 | 10/1914 | Pearl | 40/505 |
| 1,291,213 | 1/1919 | Smith | 40/430 |
| 1,399,409 | 12/1921 | Sleder | 40/505 |
| 1,767,000 | 6/1930 | Johnston et al. | 366/70 |
| 3,203,124 | 8/1965 | Stoessel | 40/539 |
| 3,654,717 | 4/1972 | Lane | 40/539 |
| 4,243,784 | 1/1981 | Akima et al. | 366/69 |

FOREIGN PATENT DOCUMENTS

| | | | |
|---|---|---|---|
| 77618 | 2/1962 | France | 40/505 |

*Primary Examiner*—Gene Mancene
*Assistant Examiner*—James Hakomaki
*Attorney, Agent, or Firm*—Sughrue, Mion, Zinn, Macpeak and Seas

[57] ABSTRACT

A dynamic display comprising a multiplicity of presentation units such as solid blocks (as shown), containers, stands or shelves arranged for rotation as at least two groups about respective parallel axes. At least one of the groups being contra rotatable with respect to the or at least one of the adjacent groups, and each of the presentation units being shaped and located to avoid interference with any of the other presentation units, with the groups being arranged in a straight line (as shown), cyclically or in a pattern, even though the paths of movement of the presentation units of adjacent ones of the groups overlap, when viewed in a direction parallel to said axes.

10 Claims, 4 Drawing Figures

INTERMESHED AND INTERLEAVED DYNAMIC DISPLAY UNITS

The present invention relates to dynamic displays, by which is meant displays where a series of items are movable into and out of view, rather than being permanently on view as in a static display.

An aim has been to retain the ability of known moving displays to present a large number of items in a compact manner whilst improving the visual impact.

In accordance with the present invention, a dynamic display comprises a multiplicity of presentation units arranged for rotation as at least two groups about respective parallel axes, at least one of the groups being contra rotatable with respect to the or at least one of the adjacent groups, and each of the presentation units being shaped and located to avoid interference with any of the other presentation units, even though the paths of movement of the presentation units of adjacent ones of the groups overlap, when viewed in a direction parallel to said axes.

It is believed that the overlapping in conjunction with the contra rotation leads to a particularly eyecatching, fascinating and aesthetically appealing dynamic display.

To maximise the visual impact inherent to the present dynamic display, the groups of the presentation units should be positioned as close to one another as possible, whilst still avoiding interference.

Preferably, a plurality of the presentation units are in different levels and avoid interference by being interleaved. Also preferably, a plurality of the presentation units are in the same level and avoid interference by being intermeshed.

If the presentation units in each group project from or define an axially extending support, but not otherwise, the distance between adjacent ones of the supports must be greater than the radius of the largest circle swept out by a presentation unit in either of the adjacent groups, but should be smaller than the sum of the radii of the smallest circles swept out by presentation units in each one of the adjacent groups.

There is no limit upon the number of the groups. For a multiplicity of the groups, their axes of rotation need not necessarily be arranged in a straight line but could be arranged cyclically or in any desirable pattern, when viewed in a direction parallel to said axes. There need not necessarily be the same number of presentation units in each of the groups.

From the foregoing, it will be appreciated that in just one example the present dynamic display could be shaped as a pyramid.

In a particular application of the present dynamic display, the presentation units are designed to carry printed advertising literature, such as Estate Agents' leaflets. Many other applications are of course possible. For example, the presentation units could be designed to carry jewellery, shoes or household goods. The design of the presentation units can thus range from blocks through containers and stands to shelves and can incorporate any combination thereof.

The present dynamic display may include at least one presentation unit of block form, at least one of said blocks being solid rather than hollow, and at least one of said solid blocks being substantially cubic, but preferably all of the presentation units are of substantially identical appearance.

The present dynamic display need not necessarily be supported from below, with the axes extending vertically, but could be suspended from above, or could be supported from the side so that the axes extend horizontally, or more generally could be so arranged and so supported that the axes extend at any desired inclination.

The presentation units are preferably rotated by a power drive, such as an electric motor, but there may be alternatively or additionally a hand drive facility. The presentation units may be rotated continuously or, especially if they carry much reading material, may rotate intermittently. The presentation units may occasionally all be rotated in their respective reverse senses of rotation.

A dynamic display in accordance with the present invention will now be described, by way of example only, with reference to the accompanying drawings, in which.

The accompanying drawings show a dynamic display 10 of generally planar form which is convenient for mounting in a shop window so that it is visible from both outside and inside the shop.

Figure 1:
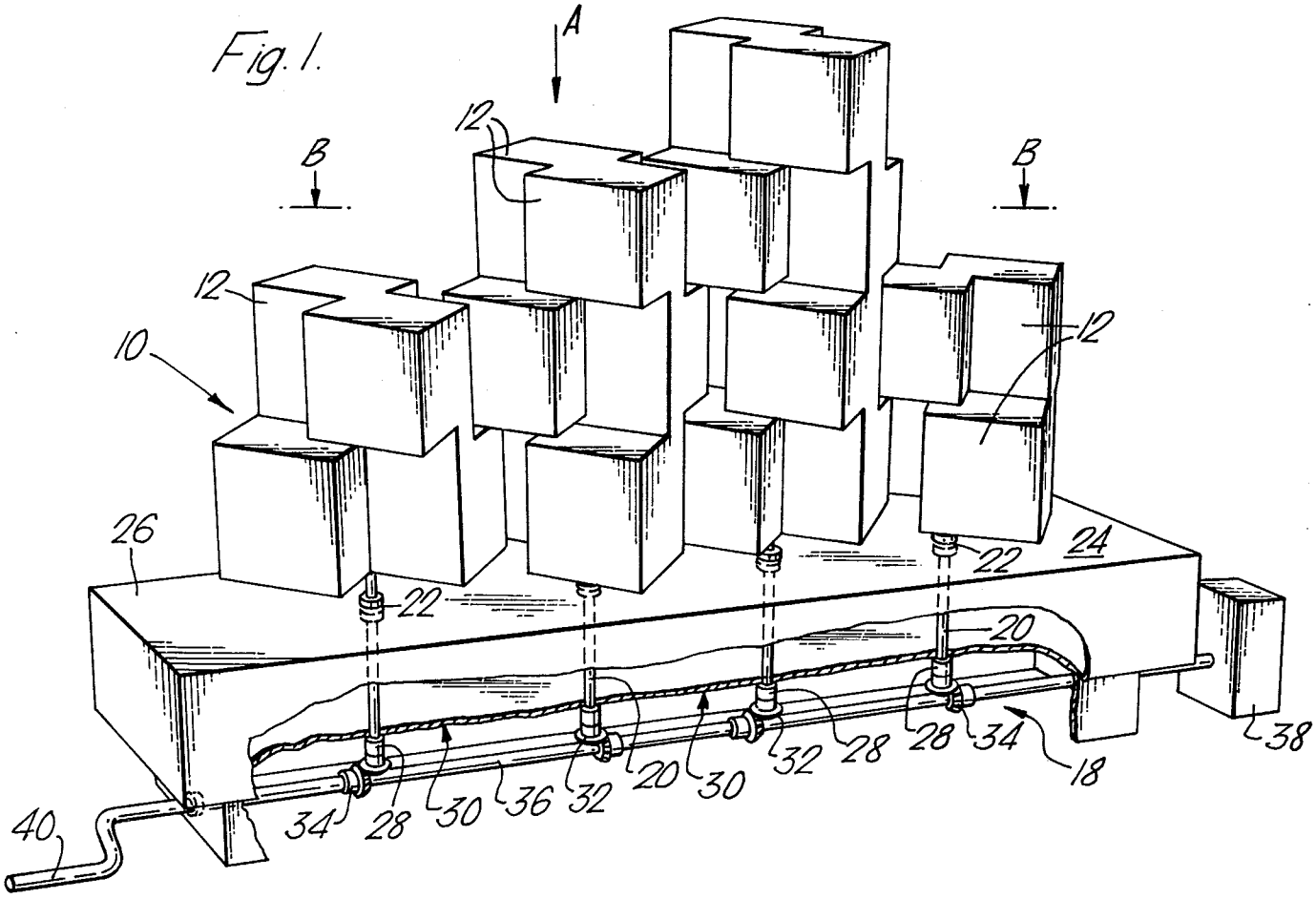
FIG. 1 is a perspective view shown partially in section to reveal a simple drive mechanism.
Figure 2:
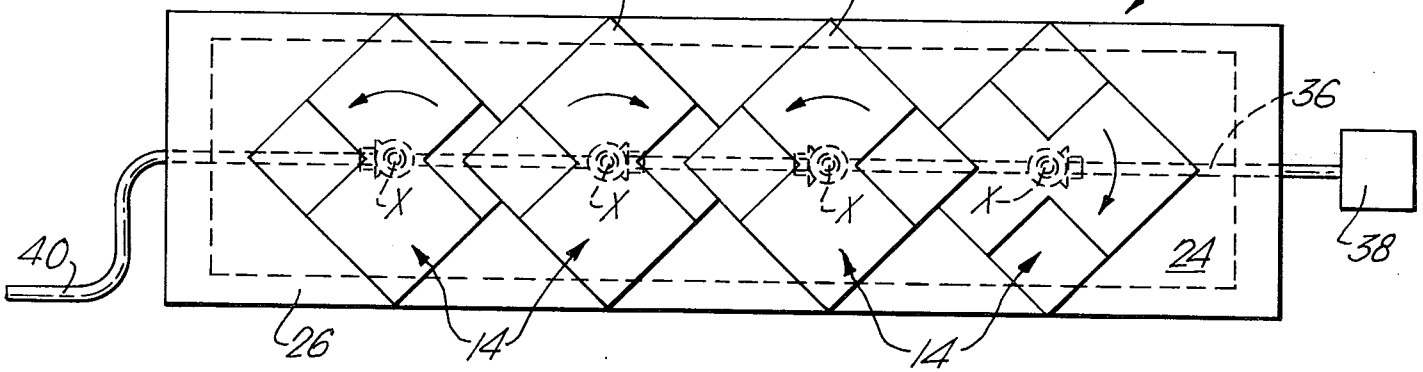
FIG. 2 is a view looking in the direction of the Arrow A in FIG. 1.
Figure 3:
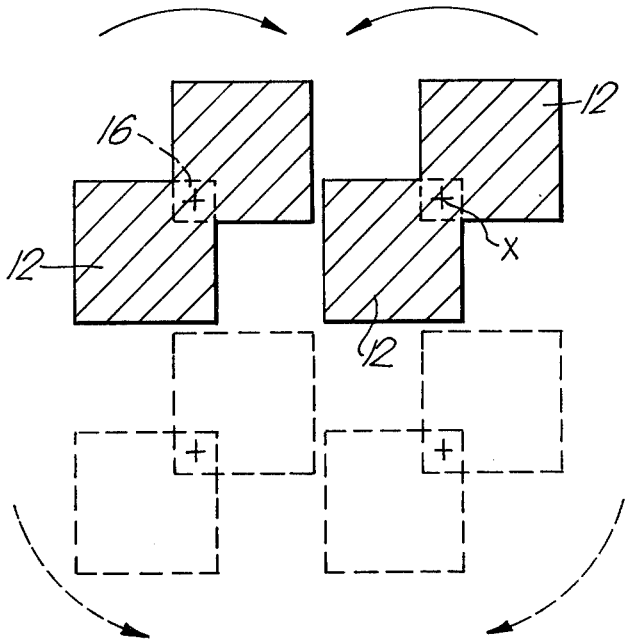
FIGS. 3 and 4 are schematic sections taken on the line B—B in FIG. 1, showing the relative positions of adjacent presentation units after each has been rotated through 45°, with further presentation units of a more extensive array being shown in phantom.
Figure 4:
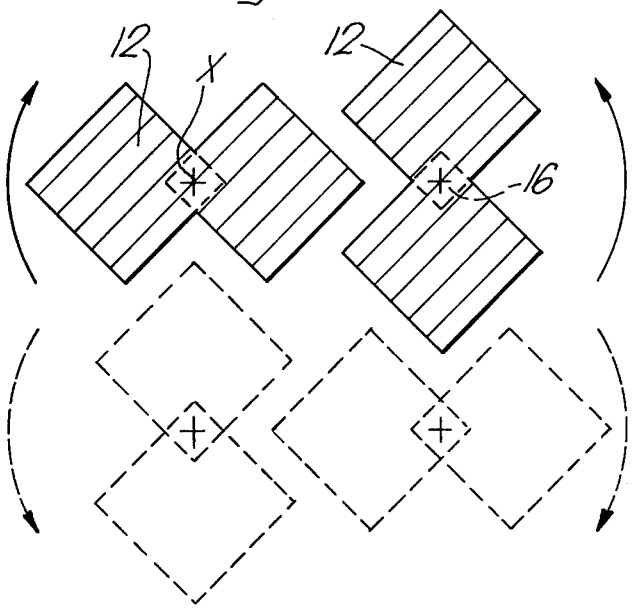

The dynamic display 10 comprises twenty-two presentation units 12 arranged for rotation as four groups 14 about respective parallel axes X. The sense of rotation of each of the groups 14 is shown in FIG. 2. During this rotation, the presentation units 12 of adjacent ones of the groups 14 overlap. Interference is avoided because the presentation units 12 are interleaved and intermeshed with respect to one another. The intermeshing action is shown particularly clearly in FIGS. 3 and 4.

The presentation units 12 are shown as solid cubes of foam which are integrally formed with one another to provide in effect for each of the groups 14 an axially extending continuous support 16.

As indicated hereinbefore, however, the presentation units may take many other different forms, and need not necessarily present axially extending supports, provided that all of the presentation units in any different one of the groups are capable of being rotated in unison.

In the particular example shown in the accompanying drawings, it is intended that advertising literature be attached to some of the faces of the cubes. Clearly, however, if the cubes were hollowed out, it would be possible for items to be located therewithin. More generally, one could depart entirely from the notion of utilising cubes, and instead utilise any other suitable shape.

The groups 14 of the presentation units 12 are rotated by a particularly simple drive mechanism 18.

The drive mechanism 18 includes four rods 20, each of which is secured axially within a respective one of the supports 16, for example by glueing. The relative axial position of the groups 14 is adjusted and then fixed by means of upper locking collars 22 which rest against an upper face 24 of a stand 26 as well as by lower locking collars 28 which rest against a lower face 30 of the stand 26. The lower free ends of the rods 20 carry bevel gears 32 which are driven by further bevel gears 34 carried by a transverse rod 36.

The transverse rod 36 can be rotated by either an electric motor 38 or a handle 40.

In the particular example shown in the accompanying drawings, it is the positioning of the bevel gears 34 on relatively opposed sides of the respective bevel gears 32 which leads to the preferred arrangement, in which each of the groups 14 is contra rotatable with respect to the or each of the adjacent groups 14.

In other examples, however, the required contra rotation can be achieved by for example a sprocket and chain drive mechanism, or a belt drive mechanism.

The dynamic display may find use as a toy, a partition or an object d'art in which case the presentation units may present ornamental or reflecting surfaces to give an even more glittering and sparkling appearance.

For the avoidance of doubt, in the accompanying claims the term plurality means two or more, and the term multiplicity means three or more, although preferably there are large numbers of both groups and presentation units.

I claim:

1. A dynamic display comprising a multiplicity of presentation units arranged for rotation as at least two groups about respective parallel axes, at least one of the groups being contra rotatable with respect to at least one of the groups adjacent thereto, each of the groups including a plurality of presentation units in different levels and a plurality of presentation units in the same level, all of the presentation units being offset from adjacent presentation units considered both longitudinally and circumferentially of each of the groups, and each of the presentation units avoiding interference with any of the other presentation units, even though the paths of movement of the presentation units of adjacent ones of the groups overlap, when viewed in a direction parallel to said axes, presentation units in adjacent groups and in different levels avoiding interference by being interleaved and presentation units in adjacent groups and in the same level avoiding interference by being intermeshed.

2. A dynamic display according to claim 1, in which at least one of the presentation units is of block form.

3. A dynamic display according to claim 2, in which at least one of the presentation units of block form is solid rather than hollow.

4. A dynamic display according to claim 3, in which at least one of the presentation units of solid block form is substantially cubic.

5. A dynamic display according to claim 1, in which all of the presentation units are of substantially identical appearance.

6. A dynamic display according to claim 1, in which each group of the presentation units incorporates an axially extending support.

7. A dynamic display according to claim 1, comprising a multiplicity of the groups whose axes of rotation, when viewed in a direction parallel to said axes, are arranged in a straight line.

8. A dynamic display according to claim 1, comprising a multiplicity of the groups whose axes of rotation, when viewed in a direction parallel to said axes, are not arranged in a straight line.

9. A dynamic display according to claim 1, in which the groups of the presentation units are intermittently rotatable by a power drive.

10. A dynamic display comprising a multiplicity of presentation units arranged for rotation as at least two groups about respective parallel axes, at least one of the groups being contra rotatable with respect to at least one of the adjacent groups, and each of the presentation units being shaped and located to avoid interference with any of the other presentation units, even though the paths of movement of the presentation units of adjacent ones of the groups overlap, when viewed in a direction parallel to said axes, in which a plurality of the presentation units are in different levels and avoid interference by being interleaved, a plurality of the presentation units are in the same level and avoid interference by being intermeshed, and a plurality of the presentation units are of substantially cubic solid block form, there being a multiplicity of the groups each of which is contra rotatable with respect to each adjacent group.

* * * * *